US011060782B2

(12) United States Patent
Scalf

(10) Patent No.: US 11,060,782 B2
(45) Date of Patent: Jul. 13, 2021

(54) REFRIGERATOR WITH ICE DISPENSER CLOSURE

(71) Applicant: Midea Group Co., Ltd., Foshan (CN)

(72) Inventor: Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 89 days.

(21) Appl. No.: 16/452,769

(22) Filed: Jun. 26, 2019

(65) Prior Publication Data

US 2020/0408451 A1 Dec. 31, 2020

(51) Int. Cl.
*F25C 5/20* (2018.01)

(52) U.S. Cl.
CPC ..... *F25C 5/22* (2018.01); *F25C 2400/10* (2013.01); *F25C 2500/02* (2013.01)

(58) Field of Classification Search
CPC .... F25C 5/22; F25C 2500/02; F25C 2400/10; F25C 5/046
USPC ..... 62/344
See application file for complete search history.

(56) References Cited

U.S. PATENT DOCUMENTS 3,572,053 A * 3/1971 Jacobus ..... F25C 1/24 62/344
3,747,363 A * 7/1973 Grimm ..... F25C 5/22 62/377
3,911,692 A 10/1975 Maxwell et al.
6,314,745 B1 11/2001 Janke et al.
6,802,186 B2 10/2004 Holmes et al.
7,942,016 B2 5/2011 Johnson et al.
8,667,808 B2 3/2014 Kim et al.
9,182,162 B2 11/2015 Culley et al.
2005/0056043 A1* 3/2005 Lee ..... F25D 23/028 62/344
2007/0251259 A1 11/2007 Kim et al.
2009/0166385 A1 7/2009 Davis et al.
2010/0044391 A1 2/2010 Fallon et al.
2010/0089493 A1* 4/2010 Seo ..... F25C 5/22 141/351
2010/0180623 A1 7/2010 Oh
2010/0262295 A1 10/2010 Lee
2013/0055741 A1 3/2013 Dirnberger et al.
2016/0370099 A1 12/2016 Yang
2021/0063071 A1* 3/2021 Scalf ..... F25C 5/22

FOREIGN PATENT DOCUMENTS

CN 201569888 U 9/2010
DE 102014206089 B4 1/2018
EP 2428755 A2 3/2012
KR 20090074962 A 7/2009

OTHER PUBLICATIONS

International Search Report and Written Opinion issued in PCT Application No. PCT/CN2020/096855, dated Sep. 17, 2020.

* cited by examiner

*Primary Examiner* — Steve S Tanenbaum
(74) *Attorney, Agent, or Firm* — Middleton Reutlinger

(57) ABSTRACT

A refrigerator utilizes an ice dispenser closure that is actuated in response to separation of a separable portion of a passageway that communicates ice from an ice dispensing mechanism to a dispenser outlet to restrict external access to the ice dispensing mechanism.

20 Claims, 5 Drawing Sheets

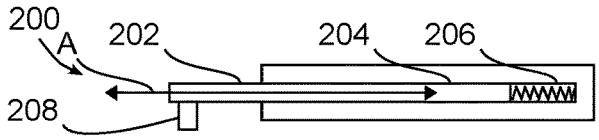
FIG. 8A
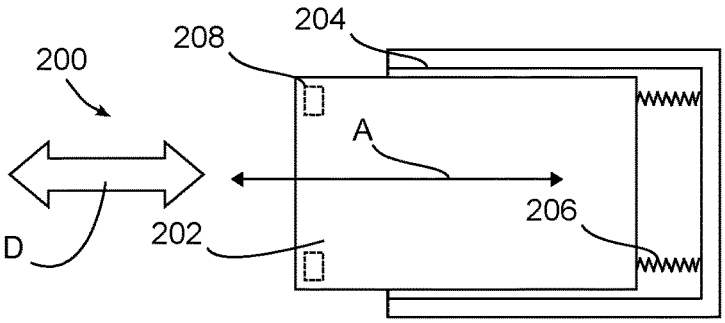
FIG. 8B
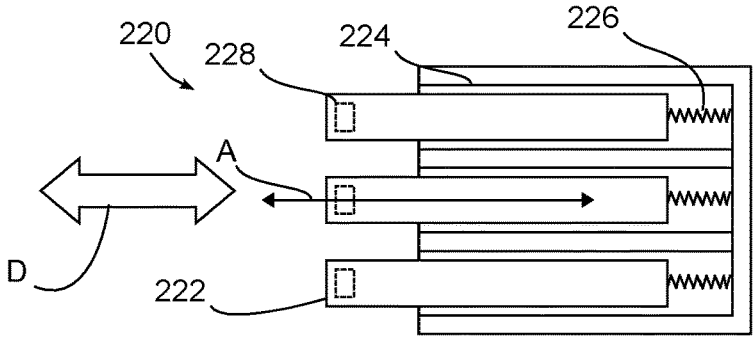
FIG. 9
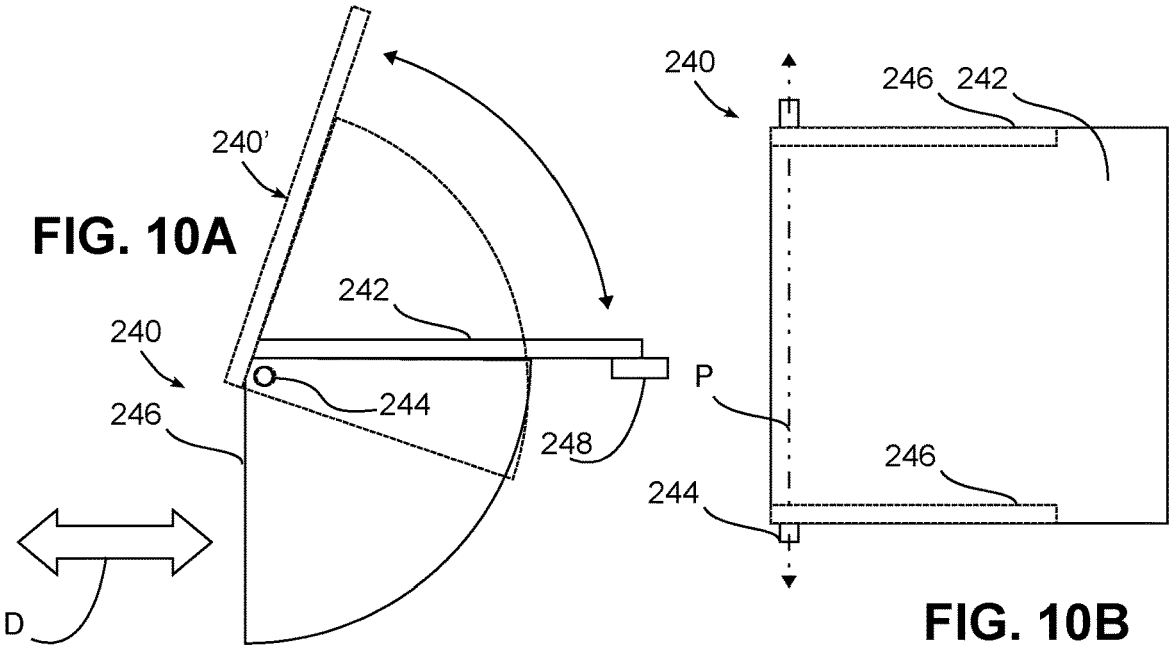
FIG. 10A
FIG. 10B

REFRIGERATOR WITH ICE DISPENSER CLOSURE

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an ice dispensing system having an externally-accessible dispenser that is disposed at a convenient height on the front of the refrigerator, most often on the surface of one of the doors that provide access to one of the refrigerator compartments. The ice dispensing system also generally includes an ice maker capable of producing ice and depositing the produced ice into a storage bin for later on-demand dispensing by a consumer.

Conveying ice from a storage bin to an externally-accessible dispenser outlet is generally performed using an ice dispensing mechanism such as a rotating auger that extends longitudinally through the storage bin and through rotation pushes ice forward towards an opening in communication with the dispenser outlet. The ice dispensing mechanism may also include an ice crusher to crush the ice prior to dispensing.

In many ice dispenser designs, an ice chute or other passageway is used to convey ice from the storage bin to the dispenser outlet, and the passageway is sized and configured to restrict access to any moving components of the ice dispensing mechanism, e.g., the ice auger and/or ice crusher, through the dispenser outlet. Various obstructions may also be positioned within the passageway to further restrict access to the moving components through the dispenser outlet. However, if any portion of the passageway is separable from the ice dispensing system, a possibility exists that the moving components could be accessed by a consumer when the portion of the passageway is separated. Therefore, a need exists in the art for a manner of restricting access to an ice dispensing mechanism when at least a portion of a passageway to a dispenser outlet is separated from the ice dispensing system.

SUMMARY

The herein-described embodiments address these and other problems associated with the art by providing a refrigerator that utilizes an ice dispenser closure that is actuated in response to separation of a separable portion of a passageway that communicates ice from an ice dispensing mechanism to a dispenser outlet to restrict access to the ice dispensing mechanism.

Therefore, consistent with one aspect of the invention, a refrigerator may include a cabinet including one or more food compartments and one or more doors closing the one or more food compartments, a storage bin disposed in the cabinet to store ice, an ice dispensing mechanism positioned upstream of an opening to convey ice from the storage bin through the opening, a passageway disposed downstream of the opening and configured to pass ice conveyed by the ice dispensing mechanism to an externally-accessible dispenser outlet, where at least a portion of the passageway is movable relative to the opening and away from an operative position, and one or more retractable blocking members disposed intermediate the opening and the externally-accessible dispenser outlet, the one or more retractable blocking members movable between retracted and blocking positions, where when in the blocking position the retractable blocking members are positioned to restrict external access to the ice dispensing mechanism through the opening, and where the retractable blocking members are configured to move from the retracted position to the blocking position in response to movement of the at least a portion of the passageway away from the operative position.

In some embodiments, the passageway, the storage bin and the ice dispensing mechanism are disposed on a first door among the one or more doors of the cabinet. Also, in some embodiments, the passageway, the storage bin and the ice dispensing mechanism are disposed on a fixed portion of the cabinet that is externally accessible when the one or more doors are closed. Further, in some embodiments, the one or more compartments includes a fresh food compartment and a freezer compartment disposed below the fresh food compartment, and the fixed portion of the cabinet includes a console that extends upwardly from a bottom wall of the fresh food compartment only a portion of a height of the fresh food compartment and is spaced apart from each of a top wall, and first and second side walls of the fresh food compartment.

In some embodiments, the passageway includes first and second portions, the second portion of the passageway is movable relative to the opening, the first and second portions of the passageway are aligned with one another when the second portion of the passageway is in the operative position, the refrigerator further includes a dispenser recess member configured to receive a container to which ice may be dispensed from the externally-accessible dispenser outlet, and the second portion of the passageway is disposed on the dispenser recess member. In addition, in some embodiments, the storage bin is a first storage bin, the dispenser recess member is slidably mounted to the cabinet to move between closed and open positions, the refrigerator further includes a second storage bin configured to store ice and movable with the dispenser recess member, and when the dispenser recess member is in the closed position, the second portion of the passageway is in the operative position, and when the dispenser recess member is in the open position, the second storage bin is externally accessible from the cabinet.

In some embodiments, the dispenser recess member and the second portion of the passageway are detachable from the cabinet. In addition, in some embodiments, at least a portion of the ice dispensing mechanism is disposed within the storage bin, and the opening, the storage bin, and the portion of the ice dispensing mechanism are movable relative to the cabinet. Moreover, in some embodiments, the storage bin and the portion of the ice dispensing mechanism are detachable from the cabinet.

In some embodiments, the ice dispensing mechanism includes a rotatable auger configured to convey ice to the opening, and the one or more blocking elements restrict external access to the rotatable auger when in the blocking position. Moreover, in some embodiments, the ice dispensing mechanism includes a crusher mechanism configured to form crushed ice, and the one or more retractable blocking elements restrict external access to the crusher mechanism when in the blocking position.

In some embodiments, the one or more retractable blocking elements includes one or more hinged doors. In addition, in some embodiments, the one or more retractable blocking elements includes one or more sliding doors. In some embodiments, the one or more retractable blocking elements includes one or more movable fingers. Moreover, in some embodiments, the one or more retractable blocking elements includes multiple retractable blocking elements.

Also, in some embodiments, each of the one or more retractable blocking elements is biased to the blocking position, movement of the at least a portion of the passageway into the operative position overcomes the bias of each of the one or more retractable blocking elements to move the one or more retractable blocking elements to the retracted position, and movement of the at least a portion of the passageway away from the operative position releases the one or more retractable blocking elements to return to the blocking position.

In some embodiments, the at least a portion of the passageway is disposed on an externally-accessible body that is movable between a closed position and an open position, and the refrigerator further includes one or more actuation surfaces operably coupled to the one or more retractable blocking elements, the one or more actuation surfaces disposed within a movement path of the externally-accessible body such that movement of the externally-accessible body to the closed position from the open position engages the one or more actuation surfaces to move the one or more retractable blocking elements to the retracted position.

In addition, in some embodiments, the storage bin and the ice dispensing mechanism extend in a generally transverse direction relative to a front face of the cabinet, the externally-accessible body is movable linearly along the generally transverse direction, the opening is generally horizontal and the one or more retractable blocking elements includes a horizontally-oriented sliding door that is slidable at least partially across the opening in the generally transverse direction, and the refrigerator further includes one or more springs operably coupled to the horizontally-oriented sliding door and configured to bias the horizontally-oriented sliding door to the blocking position such that the horizontally-oriented sliding door at least partially extends across the opening when the externally-accessible body is in the open position.

Consistent with another aspect of the invention, a refrigerator may include a cabinet including one or more food compartments and one or more doors closing the one or more food compartments, an icemaker disposed in the cabinet and configured to produce ice, an externally-accessible ice dispenser configured to dispense ice produced by the icemaker, the externally-accessible ice dispenser including first and second slidable dispenser members, each of the first and second slidable dispenser members configured to slide between closed and open positions, the first slidable dispenser member including a storage bin configured to store ice produced by the icemaker, a first portion of a passageway, and an ice dispensing mechanism at least partially disposed in the storage bin and configured to convey ice from the storage bin to the first portion of the passageway, the second slidable dispenser member disposed below the first slidable dispenser member and including a second portion of the passageway and an externally-accessible dispenser outlet, where when the first and second slidable dispenser members are in the closed position, the first and second portions of the passageway are aligned such that ice conveyed to the first portion of the passageway by the ice dispensing mechanism is passed through the first and second portions of the passageway to the externally-accessible dispenser outlet, and one or more retractable blocking members disposed downstream of the ice dispensing mechanism, the one or more retractable blocking members movable between retracted and blocking positions, where when in the blocking position the retractable blocking members are positioned to restrict external access to the ice dispensing mechanism through the first portion of the passageway, and where the retractable blocking members are configured to move from the retracted position to the blocking position in response to movement of the second slidable dispenser member away from the closed position when the first slidable dispenser member is disposed in the closed position.

Consistent with another aspect of the invention, a refrigerator may include a cabinet including a fresh food compartment disposed over a freezer compartment and including an icemaking a console that extends upwardly from a bottom wall of the fresh food compartment only a portion of a height of the fresh food compartment and is spaced apart from each of a top wall, and first and second side walls of the fresh food compartment, an icemaker disposed in the icemaking console and configured to produce ice, an externally-accessible ice dispenser disposed in the icemaking console and configured to dispense ice produced by the icemaker, the externally-accessible ice dispenser including first and second slidable dispenser members, each of the first and second slidable dispenser members configured to slide between closed and open positions, the first slidable dispenser member including a first storage bin configured to store ice produced by the icemaker, a first portion of a passageway, and an ice dispensing mechanism including an auger and a crusher mechanism and configured to convey ice from the storage bin to the first portion of the passageway, the second slidable dispenser member disposed below the first slidable dispenser member and including a second ice storage bin, a second portion of the passageway and an externally-accessible dispenser outlet, where when the first and second slidable dispenser members are in the closed position, the first and second portions of the passageway are aligned such that ice conveyed to the first portion of the passageway by the ice dispensing mechanism is passed through the first and second portions of the passageway to the externally-accessible dispenser outlet, and a horizontally-slidable door disposed on the first slidable dispenser member proximate a bottom of the first portion of the passageway and biased to a blocking position in which the horizontally-slidable door at least partially extends across the first portion of the passageway to restrict external access to the ice dispensing mechanism through the first portion of the passageway, where the horizontally-slidable door is slidable to a retracted position in response to engagement of an actuation surface of the horizontally-slidable door with the second slidable dispenser member when the first slidable dispenser member is disposed in the closed position and the second slidable dispenser member is moved into the closed position.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

FIGS. 8A and 8B are side elevational and top plan views of an example implementation of an ice dispenser closure incorporating a sliding blocking element consistent with the invention.

FIG. 9 is a top plan view of another example implementation of an ice dispenser closure incorporating multiple sliding finger blocking elements consistent with the invention.

FIGS. 10A and 10B are side elevational and top plan views of yet another example implementation of an ice dispenser closure incorporating a vertically pivotable blocking element consistent with the invention.

DETAILED DESCRIPTION

Figure 1:
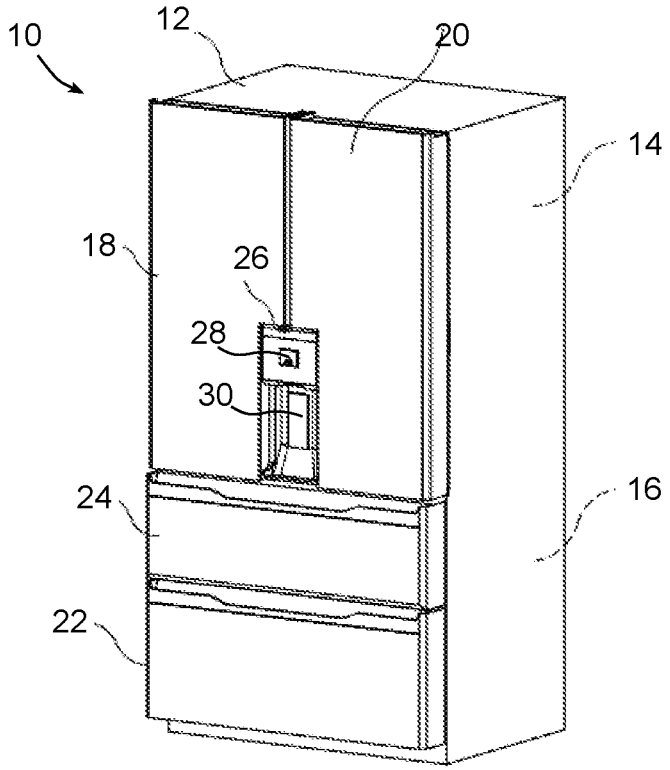
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22, 24 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, fresh food compartment doors 18, 20 are side-by-side fresh food compartment doors that are hinged along the left and right sides of the refrigerator to provide a wide opening for accessing the fresh food compartment. Freezer compartment doors 22, 24 are sliding freezer compartment doors that are similar to drawers and that pull out to provide access to items in the freezer compartment. Both the fresh food compartment and the freezer compartment may be considered to be full width as they extend substantially across the full width of the cabinet 12. It will be appreciated, however, that other door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a cabinet-mounted dispenser 26 for dispensing ice and/or water. Dispenser 26 may include one or more external user controls and/or displays, including, for example, a water dispenser control 28 and an ice dispenser control 30. In the illustrated embodiments, dispenser 26 is an ice and water dispenser capable of dispensing both ice and chilled water, while in other embodiments, dispenser 26 may be an ice only dispenser for dispensing only cubed and/or crushed ice. In still other embodiments, dispenser 26 may additionally dispense hot water, sparkling water, coffee, beverages, or other liquids, and may have variable and/or fast dispense capabilities. In some instances, ice and water may be dispensed from the same location, while in other instances separate locations may be provided in the dispenser for dispensing ice and water. In addition, while dispenser 26 is illustrated as being mounted on a fixed portion of the cabinet 12, and thus separate from any door, in other embodiments dispenser 26 may be door-mounted, and as such, may be disposed on a fresh food or freezer door. In still other embodiments, dispenser 26 may be disposed within a compartment of a refrigerator, and accessible only after opening a door.

Figure 2:
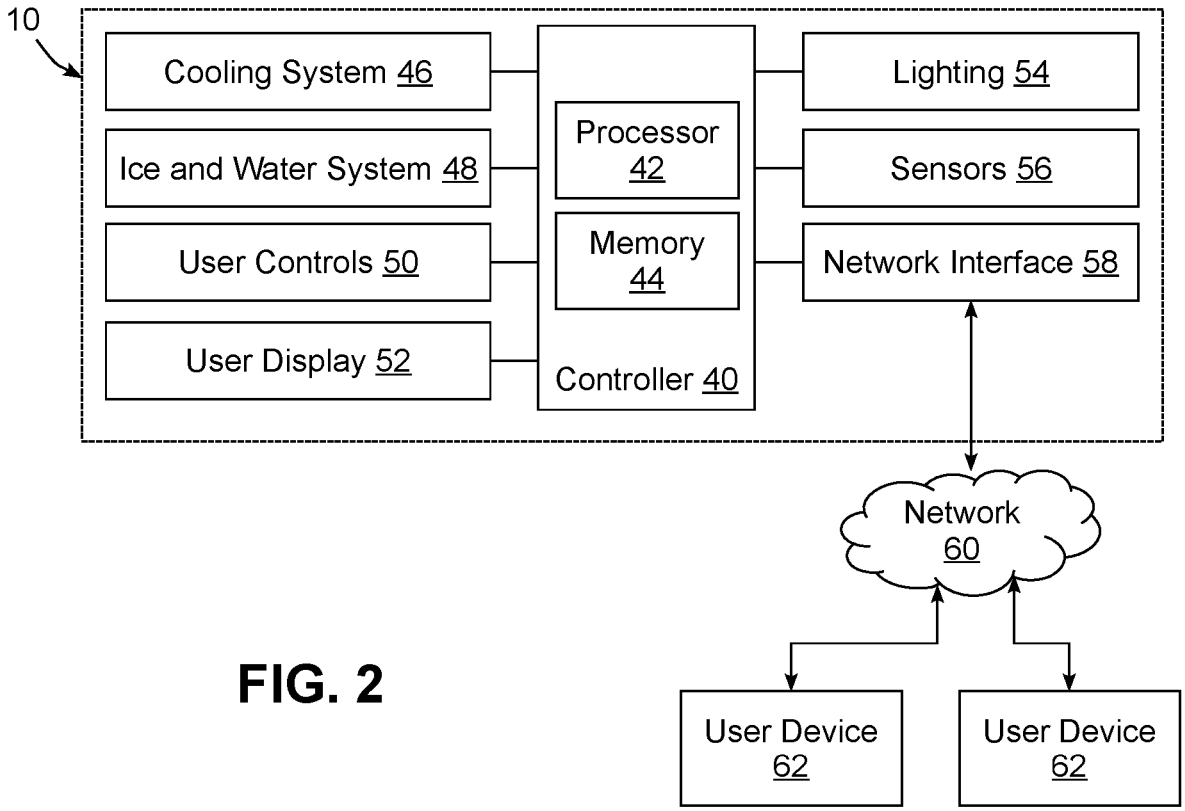
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Refrigerator with Ice Dispenser Closure

In the embodiments discussed hereinafter, a refrigerator may include an ice dispenser closure that is actuated in response to separation of a separable portion of a passageway that communicates ice from an ice dispensing mechanism to a dispenser outlet to restrict access to the ice dispensing mechanism.

FIGS. 3-7, for example, illustrate an example ice dispensing system 100 including a storage bin 102 disposed underneath an ice maker 104 and configured to receive ice produced thereby. An ice dispensing mechanism 106 is at least partially disposed in storage bin 102 and is configured to convey ice from storage bin 102 to an externally-accessible dispenser outlet 108 during an ice dispensing operation. Ice dispensing mechanism may include, for example, an ice auger 110 or other suitable ice mover (e.g., a conveyor, a paddle, etc.), and in some embodiments, may further include an ice crusher mechanism 112 configured to crush ice prior to dispensing, thereby enabling a consumer to select between cubed and crushed ice. Various types of ice mover drives, including motors, solenoids, etc., may be used to actuate ice auger and/or ice crusher mechanism during an ice dispensing operation, as will be appreciated by those of ordinary skill having the benefit of the instant disclosure.

Ice dispensing mechanism 106 may be configured to convey ice to an opening e.g., opening 113 disposed in or proximate to storage bin 102, and as such, may be considered to be upstream of the opening relative to the direction of ice flow from storage bin 102 to externally-accessible dispenser outlet 108. A passageway 114, in turn, is disposed downstream of opening 113 and is configured to pass ice conveyed by the ice dispensing mechanism 106 to externally-accessible dispenser outlet 108. In some embodiments, passageway 114 may be referred to as an ice chute.

In addition, in the illustrated embodiment, at least a portion of passageway 114 is movable relative to opening 113 and away from an operative position suitable for passing ice from opening 113 to externally-accessible dispenser outlet 108. In the illustrated embodiment, for example, passageway 114 may include first and second portions 116, 118 that are respectively disposed on first and second dispenser members 120, 122 that are each movable relative to a fixed portion of the cabinet of a refrigerator, e.g., such that each is movable between open and closed positions, with the latter positions suited for aligning portions 116, 118 of passageway 114 with one another.

Ice dispensing system 100, for example, may be suitable to implement dispenser 26 of refrigerator 10 illustrated in FIG. 1, which includes a pair of tandem ice storage bins that may be similar to that illustrated in U.S. Ser. No. 15/835,953 and U.S. Ser. No. 15/836,035, filed on Dec. 8, 2017 by Eric Scalf, and assigned to the same assignee as the present invention, which applications are incorporated by reference herein. Moreover, while at least a portion of ice dispensing system 100 may be disposed on a compartment door of a refrigerator (e.g., any of doors 18, 20, 22 and 24 of FIG. 1), in the illustrated embodiment, ice dispensing system 100 is disposed on a fixed portion of a cabinet, and separate from any compartment door, e.g., disposed in an icemaking console 124 that extends upwardly from a bottom wall of a fresh food compartment only a portion of a height of the fresh food compartment and spaced apart from each of a top wall, and first and second side walls of the fresh food compartment.

Figure 3:
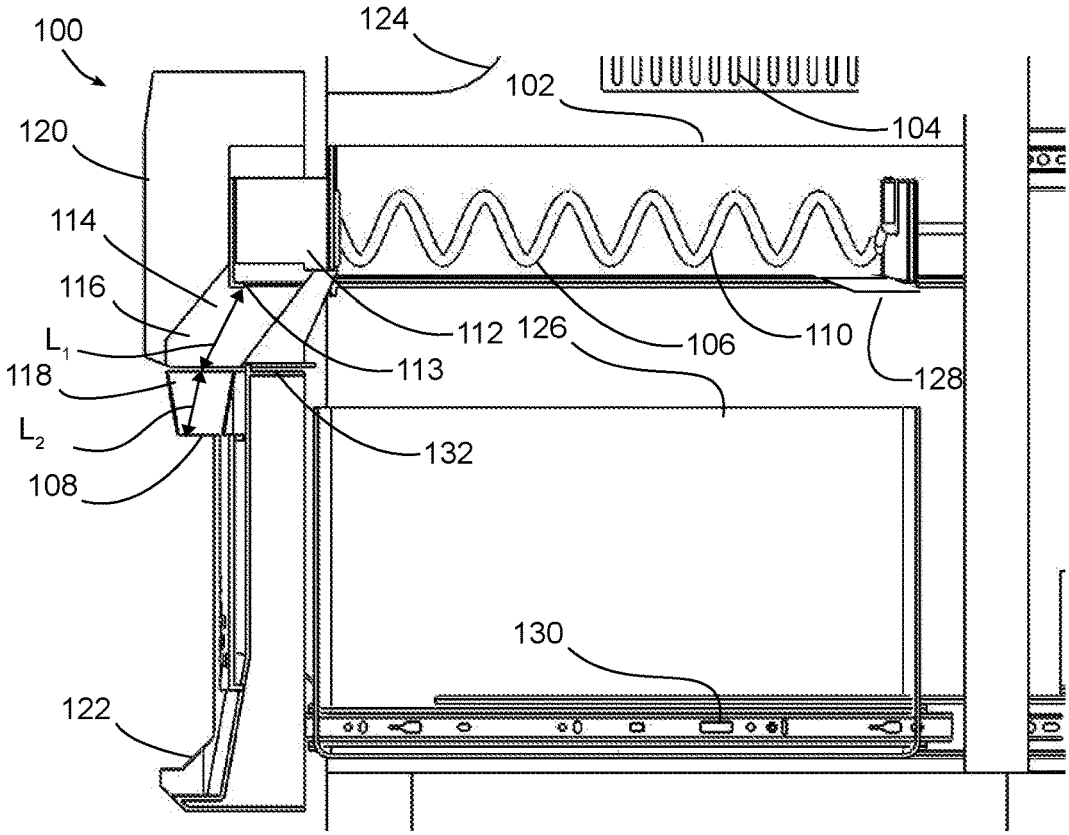
FIG. 3 is a side elevational view of an ice dispensing system utilizing an ice dispenser closure consistent with some embodiments of the invention, with portions thereof cut away.

Storage bin 102, for example, may be considered to be an upper storage bin, while a second, lower storage bin 126 may be disposed below upper storage bin 102 and configured to receive ice from upper storage bin 102 from a rearward opening 128 in upper storage bin 102 in response to reverse rotation of ice auger 110 that moves ice from the upper storage bin rearwardly within the upper storage bins. In some embodiments, dispenser members 120, 122 are respectively disposed at the front of each of storage bins 102, 126, and each is slidably mounted to the fixed portion of the cabinet such that each may be considered to be separable from the fixed portion of the cabinet. Further, while in some embodiments lower storage bin 126 may be fixed to dispenser member 122, in the illustrated embodiment dispenser member 122 is slidably mounted in console 124 using a pair of slides 130, and lower storage bin 126 is removably supported between slides 130 such that when dispenser member 122 is fully pulled out from the refrigerator, lower storage bin 126 may be completely removed from the refrigerator, e.g., to pour ice into a cooler or other container. In some embodiments, dispenser member 122 may be capable of being detached from slides 130, while in other embodiments, dispenser member 122 may not be detachable. Moreover, when each of dispenser members 120, 122 is fully pushed rearwardly to an operative position, first and second portions 116, 118 of passageway 114 are aligned with one another as illustrated in FIG. 3, and thereby capable of passing ice from storage bin 102 to dispenser outlet 108.

Upper storage bin 102 in the illustrated embodiment is also slidably mounted in console 124; however, in general use, a consumer wishing to access a large quantity of ice would do so from lower storage bin 126 rather than upper storage bin 102, so in some embodiments upper storage bin 102 may generally be removable only for maintenance purposes, e.g., to break up or remove clumped or jammed ice in the upper storage bin that is preventing ice from being dispensed from dispenser outlet 108. It will be appreciated that a separable storage bin in some embodiments may be completely detachable from a refrigerator, while in other embodiments a separable storage bin may merely be movable (e.g., rotatable and/or slidable) relative to an operative position, but still incapable of being completely detached, so the invention is not limited to the particular storage bin implementations illustrated in FIG. 3.

Furthermore, it will be appreciated that in some embodiments, one of dispenser members 120 may not be separable, and in some embodiments, additional structures, e.g., a fixed portion of console 124, may also be positioned proximate to dispenser members 120, 122 and form a portion of passageway 114.

It will be appreciated that each of dispenser members 120, 122 may be externally accessible bodies that form a portion of a front face of a refrigerator. Moreover, dispenser member 122 may be configured in some embodiments as a dispenser recess member that is capable of receiving a container to which ice may be dispensed from the externally-accessible dispenser outlet 108. Each of dispenser members 120, 122 may also include one or more controls, e.g., control paddles, buttons, sliders, touchscreens, knobs, etc., that may be used to control water and/or ice dispensing operations, and in some instances, a water outlet (not shown) may be disposed on dispenser member 120, dispenser member 122 or a different structure coupled to console 124 and disposed proximate to dispensing outlet 108.

With specific reference to FIG. 3, it may be seen that portions 116, 118 of passageway 114 are aligned with one another when dispenser members 120, 122 are pushed fully back into their closed positions, thereby providing a path for ice that is conveyed to opening 113 by ice dispensing mechanism 106 to pass to externally-accessible dispenser outlet 108. However, generally due to the size of the cubed ice and the desired rate of flow, passageway 114 may be sized such that external access to ice dispensing mechanism 106 may be possible through dispenser outlet 108, passageway 114, and opening 113. In many conventional designs, the passageway between an ice dispensing mechanism and an externally-accessible dispenser outlet is designed with a sufficient length and/or incorporates obstructions to restrict access to any moving components of the ice dispensing mechanism, e.g., the ice auger and/or ice crusher. However, it will be appreciated that if any portion of the passageway is separable from the ice dispensing system, a possibility exists that the moving components could be accessed by a consumer when the portion of the passageway is separated.

For example, as illustrated in FIG. 3, when dispenser members 120, 122 are pushed fully back into their closed positions, and thus first and second portions 116 and 118 are in their respective operative positions, the respective lengths $L_1$ and $L_2$ of the first and second portions 116, 118 of passageway 114 provide an overall distance of $L_1+L_2$ between opening 113 and dispenser outlet 108, which may be selected to provide adequate spacing to inhibit access to ice dispensing mechanism 106. However, when dispenser member 122 is pulled from the closed position to an open position (illustrated sequentially in FIGS. 4-6), second portion 118 of passageway 114 is moved away from its operative position, opening 113 potentially may be accessed through first portion 116 of passageway 114, therefore effectively reducing the distance needed to access the ice dispensing mechanism to $L_1$, the length of first portion 116.

Accordingly, to inhibit this potential access to ice dispensing mechanism 106, an ice dispenser closure incorporating one or more retractable blocking members or elements is disposed intermediate opening 113 and externally-accessible dispenser outlet 108. The one or more retractable blocking members are movable between retracted and blocking positions, such that when in the blocking position the retractable blocking members are positioned to restrict external access to ice dispensing mechanism 106 through opening 113, and such that the retractable blocking members are configured to move from the retracted position to the blocking position in response to separation of at least a portion of passageway 114 away from its operative position. In the illustrated embodiment, for example, a single retractable blocking member implemented as a horizontally-sliding door 132 is positioned on dispenser member 120 and intermediate first and second portions 116, 118, such that movement of second portion 118 away from its operative position within passageway 114 and in alignment with first portion 116 will move the horizontally-sliding door 132 from a retractable position to a blocking position to restrict access to the movable components (e.g., auger 110 and/or crusher mechanism 110) of ice dispensing mechanism 106 through opening 113.

Figure 7:
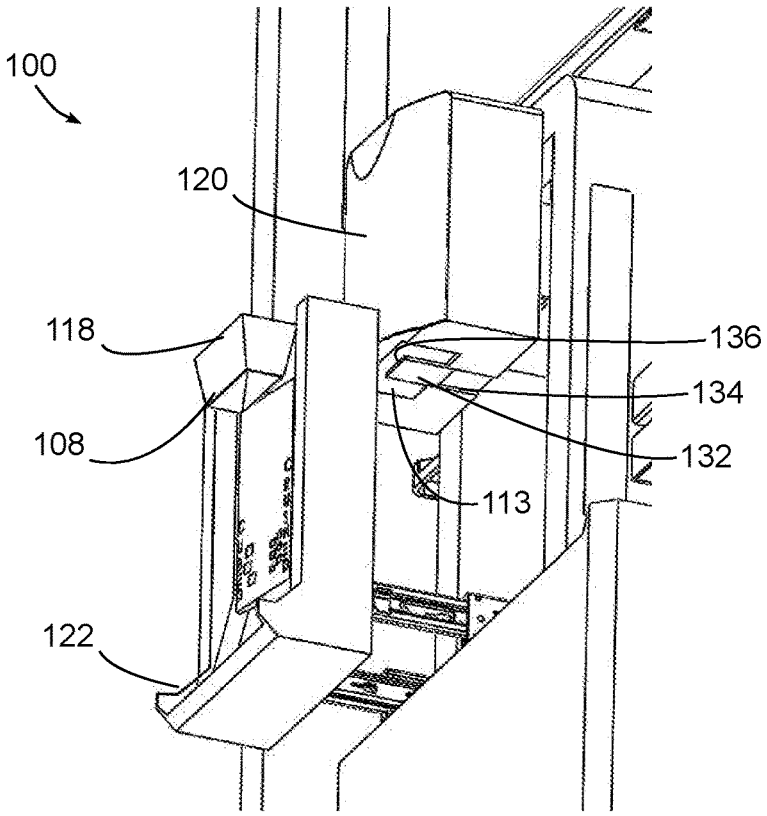
FIG. 7 is a perspective view of the ice dispensing system of FIG. 3, illustrating an ice dispenser closure in a blocking position.

With additional reference to FIG. 7, horizontally-sliding door 132 is received within a slot 134 formed in a bottom surface of dispenser member 120 and is configured to slide within a generally horizontal plane and in a direction generally transverse to a front face of the refrigerator, which is also the same general direction in which both dispenser member 120 and dispenser member 122 are also configured to slide. Horizontally-sliding door 132 is biased toward the front of the refrigerator, e.g., using one or more springs in compression or in tension, thereby providing a blocking position as illustrated in FIG. 7, with horizontally-sliding door 132 extending at least partially across first portion 116 of passageway 114. Horizontally-sliding door 132 is movable to a retracted position that is generally away from the front of the refrigerator, with all or at least a substantial portion of the door retracted to a position outside of the passageway, and thereby providing a relatively free pathway for ice passed through opening 113 by ice dispensing mechanism 106.

While various manners of overcoming the bias of horizontally-sliding door 132 towards the blocking position may be used, in the illustrated embodiment (see, e.g., FIG. 6) an actuation surface 136 is defined along a forward facing edge or surface of door 132, and is positioned such that it is within a movement path of dispenser member 122, and in this regard, dispenser member 122 may also include one or more actuation surfaces, e.g., a lip 138, that are designed to engage with actuation surface 136 when dispenser member 122 is pushed from its open position to its closed position, such that movement of the dispenser member 122 to the closed position engages actuation surface 136 of door 132 to slide the door rearwardly into the retracted position illustrated in FIG. 3, in which door 132 does not appreciably project into passageway 114.

Figure 4:
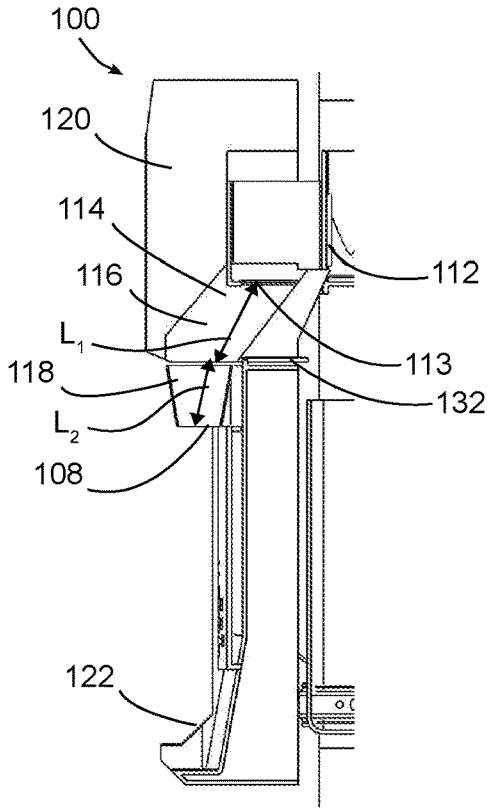
FIGS. 4-6 are side elevational views of the ice dispensing system of FIG. 3, with a dispenser recess moved progressively away from an operative position.
Figure 5:
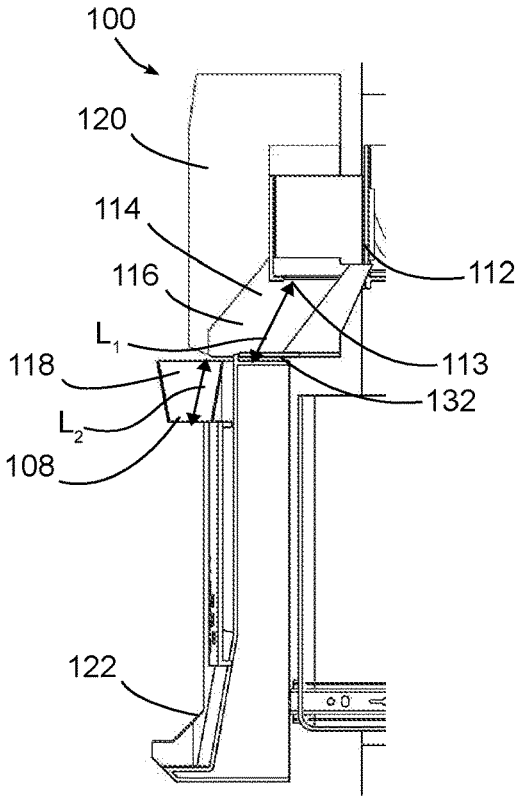
Figure 6:
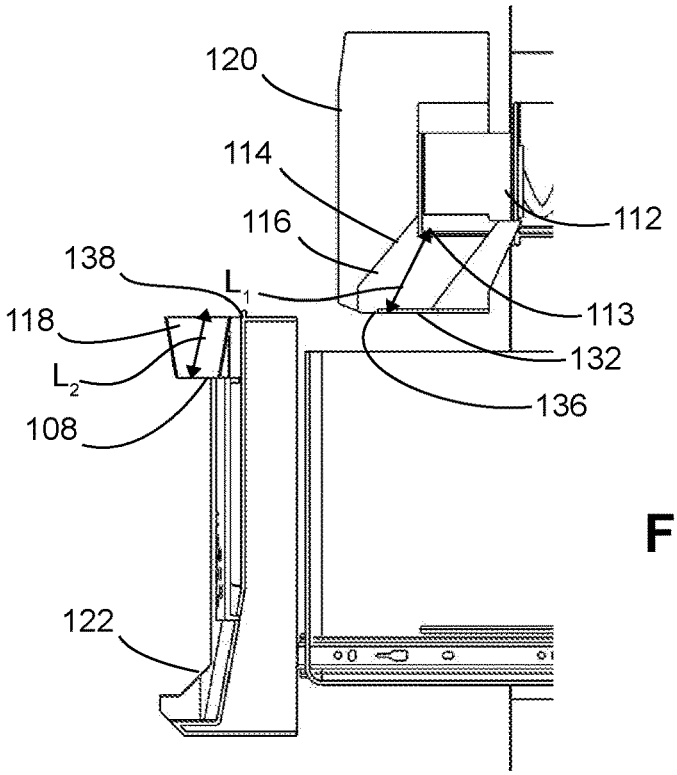

FIGS. 4-6 next illustrate the progressive movement of dispenser member 122 from the closed position to the open position, e.g., in response to pulling the dispenser member forward and away from the front of the refrigerator. As illustrated in these figures, as dispenser member 122 moves away from the closed position, the bias applied to door 132 slides door 132 forward and into the blocking position, such that even though dispenser member 122 is in an open position and second portion 118 no longer forms a part of passageway 114, access to ice dispensing mechanism 106 through opening 113 and passageway 114 is still substantially inhibited.

It will be appreciated that a number of different types, numbers, positions and configurations of blocking elements may be used in other embodiments consistent with the invention, including, for example, hinged doors, sliding doors, movable fingers, etc., as well as blocking elements that are movable about horizontal or vertical axes, or about other axes suited for a particular design. Moreover, the manner in which a blocking element may be moved between a retracted position and a blocking position may vary, including, for example, using different actuation surfaces on a blocking element or another body that is movable relative to the opening. In addition, various bias mechanisms may be used in different embodiments to urge a blocking element to a blocking position, e.g., various types of springs, gravity, etc.

FIGS. 8A-8B, for example, illustrate another example design of an ice dispenser closure blocking element 200, implemented as a sliding door 202 that slides along an axis A within a slot 204, and biased towards a blocking position by multiple compressed springs 206. Unlike door 132, door 202 includes multiple pins 208 extending below the plane of the door and serving as actuation surfaces to engage a complementary structure on a dispenser recess or other movable part of an ice dispenser based upon movement of that part generally along a direction D. Door 202 may be horizontally sliding in some embodiments, or may be oriented in other directions, and in some embodiments, door 202 may cover all or only a portion of the passageway when in the blocking position.

FIG. 9 illustrates another example design of an ice dispenser closure that, rather than using a single door, utilizes multiple (e.g., three) slidable fingers 222 sliding within individual slots 224 and with individual springs 226 and pins 228 serving as actuation surfaces. Each finger 222 is movable generally along an axis A in response to movement of a dispenser recess or other movable part along direction D.

FIGS. 10A-10B illustrate yet another example design of an ice dispenser closure 240, implemented as a pivoting door 242 that is mounted using a pair of opposing pins 244 to pivot about a horizontal pivot axis P, and that includes a pair of downwardly-extending wedges 246 that serve as actuation surfaces for the blocking element. In particular, when in a blocking position, an end of door 242 may be supported on a ledge 248 around the perimeter of the passageway, and in response to movement of a dispenser recess or other movable part along direction D, ice dispenser closure 240 may pivot upwardly, e.g., as illustrated at 240', and into a retracted position. Further, rather than having a mechanical bias, ice dispenser closure 240 may be biased via gravity to the blocking position.

Figure 11:
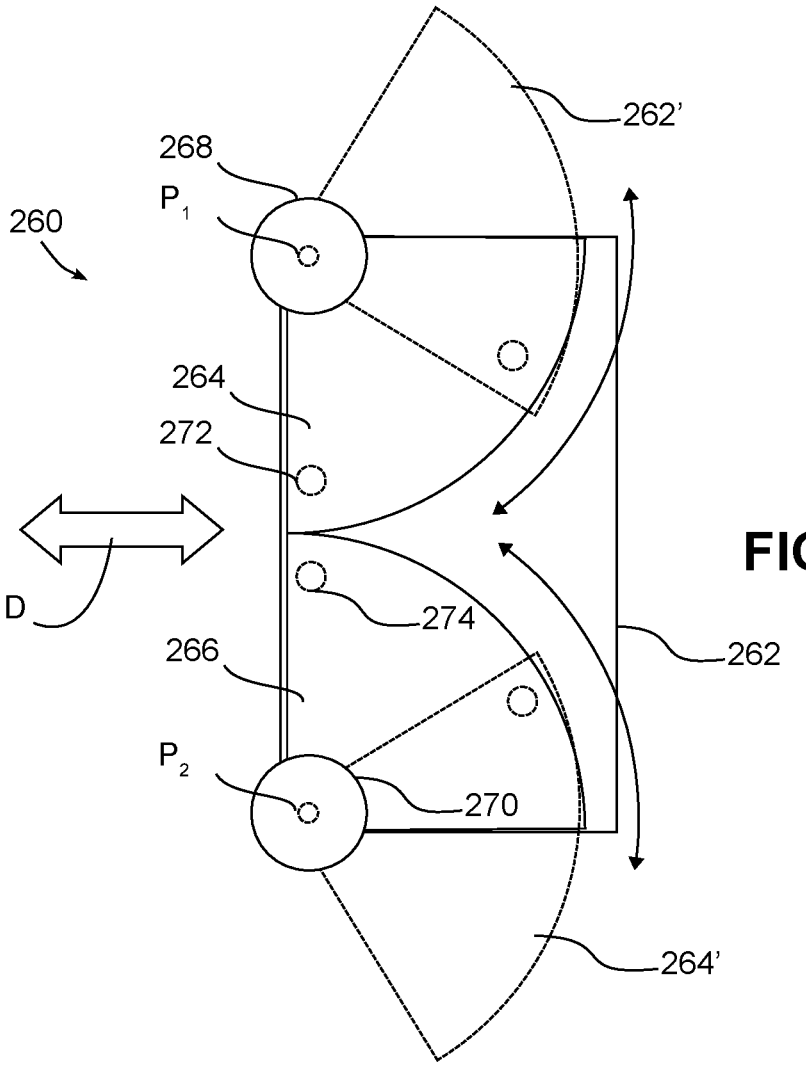
FIG. 11 is a top plan view of another example implementation of an ice dispenser closure incorporating multiple horizontally pivotable blocking elements consistent with the invention.

FIG. 11 illustrates yet another example design of an ice dispenser closure 260 configured to restrict access through a passageway 262, implemented using a pair of pivoting doors 264, 266 that each pivot about a substantially vertical pivot axis $P_1$, $P_2$, and that are each biased to a blocking position by a leaf or clock spring 268, 270. Each door 264, 266 also includes a downwardly-projecting pin 272, 274 serving as an actuation surface such that when a recess member or other body moves along a direction D, each door 264, 266 is pivoted from a blocking position towards a retracted position, e.g., as illustrated at 262', 264'.

Therefore, it will be appreciated that an ice dispenser closure consistent with the invention may restrict access to an ice dispensing mechanism when a portion of a passageway between the ice dispensing mechanism and an ice dispenser outlet is separated. It will also be appreciated that in some embodiments, additional protection against access to ice dispensing mechanism may be combined with an ice dispenser closure, e.g., through the use of AC and/or DC circuits that are disconnected (e.g., through the use of matched contacts or switches) in response to movement of a dispenser recess or other body away from an operative position, and that when disconnected inhibit power to the ice dispensing mechanism.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including one or more food compartments and one or more doors closing the one or more food compartments;

a storage bin disposed in the cabinet to store ice;

an ice dispensing mechanism positioned upstream of an opening to convey ice from the storage bin through the opening;

a passageway disposed downstream of the opening and configured to pass ice conveyed by the ice dispensing mechanism to an externally-accessible dispenser outlet when in an operative position, wherein at least a portion of the passageway is movable relative to the opening and away from the operative position, and wherein the at least a portion of the passageway is moveable into the operative position at least partially through rearward movement relative to the cabinet and movable away from the operative position at least partially through forward movement relative to the cabinet; and one or more retractable blocking members disposed intermediate the opening and the externally-accessible dispenser outlet, the one or more retractable blocking members movable between retracted and blocking positions, wherein when in the blocking position the one or more retractable blocking members are positioned to restrict external access to the ice dispensing mechanism through the opening, and wherein the one or more retractable blocking members are configured to move from the retracted position to the blocking position in response to movement of the at least a portion of the passageway away from the operative position.

2. The refrigerator of claim 1, wherein the passageway, the storage bin and the ice dispensing mechanism are disposed on a first door among the one or more doors of the cabinet.

3. The refrigerator of claim 1, wherein the ice dispensing mechanism includes a rotatable auger configured to convey ice to the opening, and wherein the one or more blocking members restrict external access to the rotatable auger when in the blocking position.

4. The refrigerator of claim 1, wherein the ice dispensing mechanism includes a crusher mechanism configured to form crushed ice, and wherein the one or more retractable blocking members restrict external access to the crusher mechanism when in the blocking position.

5. The refrigerator of claim 1, wherein the one or more retractable blocking members includes one or more hinged doors.

6. The refrigerator of claim 1, wherein the one or more retractable blocking members includes one or more sliding doors.

7. The refrigerator of claim 1, wherein the one or more retractable blocking members includes one or more movable fingers.

8. The refrigerator of claim 1, wherein the one or more retractable blocking members includes multiple retractable blocking members.

9. The refrigerator of claim 1, wherein each of the one or more retractable blocking members is biased to the blocking position, wherein movement of the at least a portion of the passageway into the operative position overcomes the bias of each of the one or more retractable blocking members to move the one or more retractable blocking members to the retracted position, and wherein movement of the at least a portion of the passageway away from the operative position releases the one or more retractable blocking members to return to the blocking position.

10. The refrigerator of claim 1, wherein the passageway, the storage bin and the ice dispensing mechanism are disposed on a fixed portion of the cabinet that is externally accessible when the one or more doors are closed.

11. The refrigerator of claim 10, wherein the one or more compartments includes a fresh food compartment and a freezer compartment disposed below the fresh food compartment, and wherein the fixed portion of the cabinet comprises a console that extends upwardly from a bottom wall of the fresh food compartment only a portion of a height of the fresh food compartment and is spaced apart from each of a top wall, and first and second side walls of the fresh food compartment.

12. The refrigerator of claim 1, wherein the passageway includes first and second portions, wherein the second portion of the passageway is movable relative to the opening, wherein the first and second portions of the passageway are aligned with one another when the second portion of the passageway is in the operative position, wherein the refrigerator further comprises a dispenser recess member configured to receive a container to which ice may be dispensed from the externally-accessible dispenser outlet, and wherein the second portion of the passageway is disposed on the dispenser recess member.

13. The refrigerator of claim 12, wherein the storage bin is a first storage bin, wherein the dispenser recess member is slidably mounted to the cabinet to move between closed and open positions, wherein the refrigerator further comprises a second storage bin configured to store ice and movable with the dispenser recess member, and wherein when the dispenser recess member is in the closed position, the second portion of the passageway is in the operative position, and when the dispenser recess member is in the open position, the second storage bin is externally accessible from the cabinet.

14. The refrigerator of claim 12, wherein the dispenser recess member and the second portion of the passageway are detachable from the cabinet.

15. The refrigerator of claim 1, wherein at least a portion of the ice dispensing mechanism is disposed within the storage bin, and wherein the opening, the storage bin, and the portion of the ice dispensing mechanism are movable relative to the cabinet.

16. The refrigerator of claim 15, wherein the storage bin and the portion of the ice dispensing mechanism are detachable from the cabinet.

17. The refrigerator of claim 1, wherein the at least a portion of the passageway is disposed on an externally-accessible body that is movable between a closed position and an open position, and wherein the refrigerator further comprises one or more actuation surfaces operably coupled to the one or more retractable blocking members, the one or more actuation surfaces disposed within a movement path of the externally-accessible body such that movement of the externally-accessible body to the closed position from the open position engages the one or more actuation surfaces to move the one or more retractable blocking members to the retracted position.

18. The refrigerator of claim 17, wherein the storage bin and the ice dispensing mechanism extend in a generally transverse direction relative to a front face of the cabinet, wherein the externally-accessible body is movable linearly along the generally transverse direction, wherein the opening is generally horizontal and the one or more retractable blocking members includes a horizontally-oriented sliding door that is slidable at least partially across the opening in the generally transverse direction, and wherein the refrigerator further includes one or more springs operably coupled to the horizontally-oriented sliding door and configured to bias the horizontally-oriented sliding door to the blocking position such that the horizontally-oriented sliding door at least partially extends across the opening when the externally-accessible body is in the open position.

19. A refrigerator, comprising:

a cabinet including one or more food compartments and one or more doors closing the one or more food compartments;

a storage bin disposed in the cabinet to store ice;

an ice dispensing mechanism positioned upstream of an opening to convey ice from the storage bin through the opening;

a passageway disposed downstream of the opening and configured to pass ice conveyed by the ice dispensing mechanism to an externally-accessible dispenser outlet, wherein at least a portion of the passageway is movable relative to the opening and away from an operative position; and one or more retractable blocking members disposed intermediate the opening and the externally-accessible dispenser outlet, the one or more retractable blocking members movable between retracted and blocking positions, wherein when in the blocking position the one or more retractable blocking members are positioned to restrict external access to the ice dispensing mechanism through the opening, and wherein the one or more retractable blocking members are configured to move from the retracted position to the blocking position in response to movement of the at least a portion of the passageway away from the operative position;

wherein the passageway includes first and second portions, wherein the second portion of the passageway is movable relative to the opening, wherein the first and second portions of the passageway are aligned with one another when the second portion of the passageway is in the operative position, wherein the refrigerator further comprises a dispenser recess member configured to receive a container to which ice may be dispensed from the externally-accessible dispenser outlet, wherein the second portion of the passageway is disposed on the dispenser recess member, wherein the storage bin is a first storage bin, wherein the dispenser recess member is slidably mounted to the cabinet to move between closed and open positions, wherein the refrigerator further comprises a second storage bin configured to store ice and movable with the dispenser recess member, and wherein when the dispenser recess member is in the closed position, the second portion of the passageway is in the operative position, and when the dispenser recess member is in the open position, the second storage bin is externally accessible from the cabinet.

20. A refrigerator, comprising:

a cabinet including one or more food compartments and one or more doors closing the one or more food compartments;

a storage bin disposed in the cabinet to store ice;

an ice dispensing mechanism positioned upstream of an opening to convey ice from the storage bin through the opening;

a passageway disposed downstream of the opening and configured to pass ice conveyed by the ice dispensing mechanism to an externally-accessible dispenser outlet, wherein at least a portion of the passageway is movable relative to the opening and away from an operative position; and one or more retractable blocking members disposed intermediate the opening and the externally-accessible dispenser outlet, the one or more retractable blocking members movable between retracted and blocking positions, wherein when in the blocking position the one or more retractable blocking members are positioned to restrict external access to the ice dispensing mechanism through the opening, and wherein the one or more retractable blocking members are configured to move from the retracted position to the blocking position in response to movement of the at least a portion of the passageway away from the operative position;

wherein at least a portion of the ice dispensing mechanism is disposed within the storage bin, and wherein the opening, the storage bin, and the portion of the ice dispensing mechanism are movable relative to the cabinet.

* * * * *